US008278807B2

(12) United States Patent
Agneray et al.

(10) Patent No.: US 8,278,807 B2
(45) Date of Patent: Oct. 2, 2012

(54) RADIOFREQUENCY PLASMA GENERATION DEVICE

(75) Inventors: Andre Agneray, Boulogne (FR); Marc Pariente, Paris (FR)

(73) Assignee: Renault S.A.S., Boulogne Billancourt (FR)

( * ) Notice: Subject to any disclaimer, the term of this patent is extended or adjusted under 35 U.S.C. 154(b) by 305 days.

(21) Appl. No.: 12/445,636

(22) PCT Filed: Jul. 3, 2007

(86) PCT No.: PCT/FR2007/051582

§ 371 (c)(1), (2), (4) Date: May 21, 2009

(87) PCT Pub. No.: WO2008/047013

PCT Pub. Date: Apr. 24, 2008

(65) Prior Publication Data

US 2010/0187999 A1 Jul. 29, 2010

(30) Foreign Application Priority Data

Oct. 17, 2006 (FR) ..... 06 09081

(51) Int. Cl.
*F02M 57/06* (2006.01)
*H05H 1/24* (2006.01)

(52) U.S. Cl. ..... 313/118; 315/111.51; 123/605; 123/606; 123/608

(58) Field of Classification Search ..... 315/111.51; 123/605, 606, 608; 313/118
See application file for complete search history.

(56) References Cited

U.S. PATENT DOCUMENTS

| | | | | |
|---|---|---|---|---|
| 5,315,982 | A * | 5/1994 | Ward et al. | 123/634 |
| 6,550,463 | B1 * | 4/2003 | Schmolla | 123/606 |
| 6,662,793 | B1 * | 12/2003 | Allen et al. | 123/620 |
| 6,857,420 | B2 * | 2/2005 | Weimert | 123/635 |
| 7,204,220 | B2 * | 4/2007 | Schmidt et al. | 123/143 B |
| 7,305,954 | B2 * | 12/2007 | Hagiwara et al. | 123/143 B |
| 2004/0123851 | A1 * | 7/2004 | Schmidt et al. | 123/606 |
| 2004/0149256 | A1 * | 8/2004 | Dye et al. | 123/297 |

FOREIGN PATENT DOCUMENTS

| | | | |
|---|---|---|---|
| EP | 1515408 | A2 * | 3/2005 |
| FR | 2 859 830 | | 3/2005 |
| FR | 2 878 658 | | 6/2006 |

* cited by examiner

*Primary Examiner* — Douglas W Owens
*Assistant Examiner* — Thai Pham
(74) *Attorney, Agent, or Firm* — Oblon, Spivak, McClelland, Maier & Neustadt, L.L.P.

(57) ABSTRACT

A device including two plasma generation electrodes, a series resonator having a resonant frequency above 1 MHz and including a capacitor with two terminals, and an induction coil surrounded by a screen, the capacitor and the coil being placed in series, the electrodes being connected to the respective terminals of the capacitor. The ratio of the spark plug to the radius of the screen is equal to 0.56. The device can optimize the Q-factor of such a device by adjusting the radius of the coil to that of the screen.

13 Claims, 2 Drawing Sheets

Prior Art

RADIOFREQUENCY PLASMA GENERATION DEVICE

BACKGROUND

The present invention relates in general to the generation of plasma in a gas, and more specifically to plasma generating devices with inbuilt inductance. Plasma generation is used in particular for the controlled ignition of internal combustion engines by the electrodes of a spark plug, but can also be used, for example, for sterilization in an air-conditioning method or pollution reduction systems.

More specifically, the invention relates to a plasma generating device comprising two electrodes, a series resonator with a resonant frequency higher than 1 MHz and comprising a capacitor equipped with two terminals and an inductive coil surrounded by a shield, the capacitor and the coil being arranged in series, the electrodes being connected to the respective terminals of the capacitor.

A device such as this is described in particular in the form of a spark plug in document FR 2 859 830. This type of spark plug exhibits low internal parasitic capacitances and forms a series resonator that has a high Q-factor. Although this device is able to sustain a radiofrequency voltage between its electrodes to generate a plasma, optimizing it has hitherto remained problematic.

BRIEF SUMMARY

This being the case, it is an object of the invention to propose a radiofrequency plasma generating device that performs even better.

To this end, the device of the present invention, in other respects in accordance with the definition thereof given in the above preamble, is essentially characterized in that the ratio of the radius of the coil $r_{int}$ to the radius of the shield $r_{ext}$ is between 0.5 and 0.6 and preferably equal to 0.56.

Further specifics and advantages of the invention will become clearly apparent from reading the following description which is given by way of nonlimiting example and from studying the figures.

DETAILED DESCRIPTION

Figure 1:
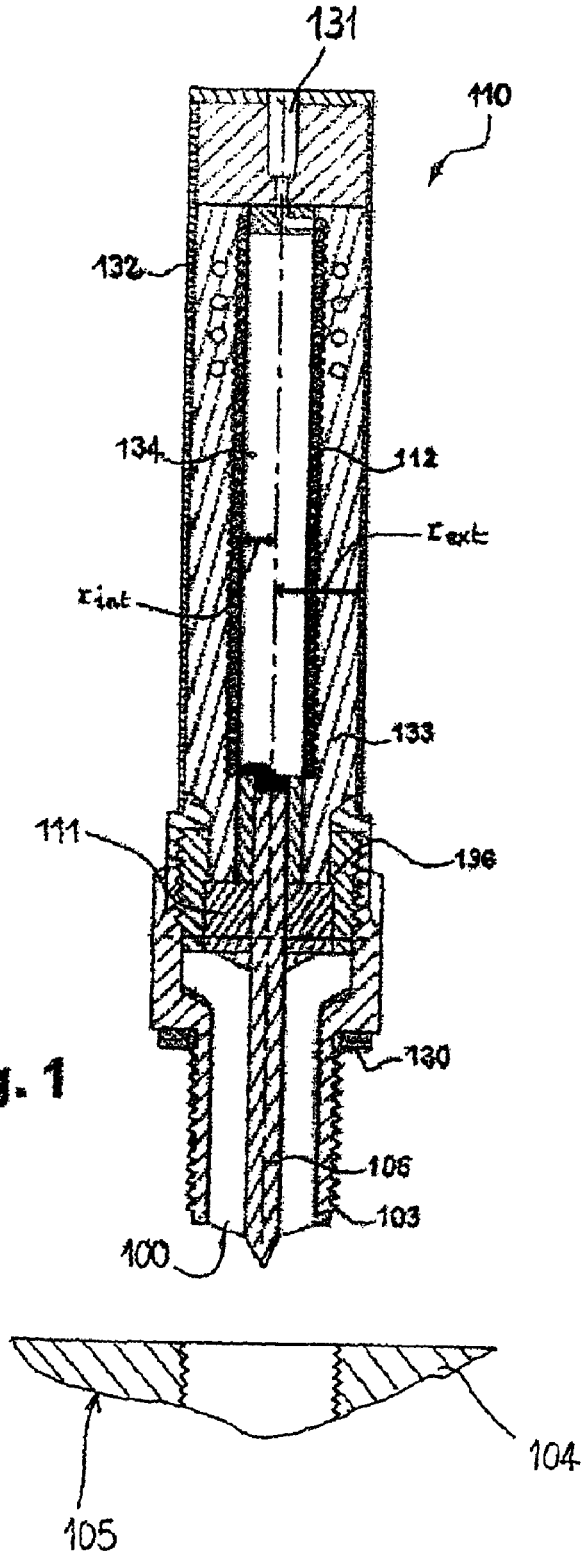
FIG. 1 is a sectioned schematic depiction of one example of a spark plug that can be used in the plasma generating system.

FIG. 1 illustrates details of the structure of a radiofrequency plasma generating device of the prior art, in the form of a surface-spark spark plug for which application of a radiofrequency excitation proves to be particularly advantageous.

The spark plug 110 may be fixed to the cylinder head 104 of an internal combustion engine 105 of a motor vehicle.

The surface-effect spark plug 110 comprises a low-voltage cylindrical electrode which acts as a metal shell 103 intended to be screwed into a recess made in the cylinder head of an engine and which opens to the inside of the combustion chamber. The shell 103 is intended to be electrically connected to ground. Thus, the shell 103 surrounds a cylindrical high-voltage electrode 106 positioned centrally.

The electrode 106 is insulated from the shell 103 by an insulating sleeve 100. The insulating sleeve is made of a material the relative permittivity of which is greater than 1, for example a ceramic. The spark plug has a gap 105 separating the dielectric 100 from one end of the electrode 103.

For applications to automotive ignition, a person skilled in the art will use electrodes and an insulator that are of materials and of geometries suited to initiating combustion in a mixture at a combustion density and to resist the plasma thus formed.

FIG. 1 also depicts a sectioned view of a spark plug advantageously incorporating a series resonator like the one described in the abovementioned prior art document. The spark plug 110 has a connection terminal 131 connected to a first end of an inductive coil 112. The second end of the inductive coil 112 is connected to an internal end of the high-voltage electrode 106. This end is also in contact with an insulating element 111 that makes up the capacitor.

The electrodes 103 and 106 in this example are separated by the dielectric material 100. The series resonator incorporated into the spark plug 110 comprises the inductive coil 112 and the insulating element 100 that also forms the capacitor between the electrodes 103 and 106. The capacitor and the inductive coil 112 are arranged in series. The series capacitance of the series resonator is formed of the capacitor and of the internal parasitic capacitances of the spark plug. This capacitance is arranged in series with an inductor to form the series resonator. When the length of the connection between the inductor and the capacitor is short, the parasitic capacitances in the spark plug are reduced. The spark plug 110 is thus used to sustain the AC voltage between the electrodes 103 and 106 in the desired frequency range, preferably from 1 MHz to 20 MHz.

The series resonator incorporated into the spark plug preferably has a single inductive coil 112, making such a spark plug easier to manufacture.

A high number of turns in the single coil 112 is needed to obtain an inductance of the order of 50 μH. Now, a high number of turns generates parasitic capacitances. The single inductive coil 112 preferably has an axis (identified by the chain line) and is made up of a plurality of turns superposed along its axis. It will thus be appreciated that the projection of one turn is the same as the projection of all the turns along this axis. The parasitic capacitances can therefore be limited by not superposing the turns radially.

The spark plug also advantageously comprises a shield 132 connected to ground and surrounding the inductive coil 112. The field lines are thus closed on themselves inside the shield 132. The shield 132 thus reduces the parasitic electromagnetic emissions of the spark plug 110. The coil 112 can actually generate intense electromagnetic fields with the radiofrequency excitation that is intended to be applied between the electrodes. These fields may, in particular, disrupt systems carried on board a vehicle or exceed the threshold levels defined in emission standards. The shield 132 is preferably made of a non-ferrous metal with high conductivity, such as copper or silver. In particular it is possible to use a conductive loop as a shield 132.

The coil 112 and the shield 132 are preferably separated by an insulating sleeve 133 made of a suitable dielectric material, with a dielectric coefficient greater than 1, and preferably a good dielectric strength in order further to reduce the risk of breakdown or corona discharge, which cause energy to be dissipated. Of course, the lower the dissipation of energy, the higher the amplitude of the voltage applied between the electrodes and the longer the life of the spark plug. The dielectric material may, for example, be one of the silicone resins marketed under the references Elastosil M4601, Elastosil RTV-2 or Elastosil RT622 (the latter having a withstand voltage of 20 kV/mm and a dielectric constant of 2.8). Provision may be made for the exterior surface of the sleeve 133 to be metalized in order to form the aforementioned shield 132.

In general, preference will be given to a winding of the coil 112 about a solid element 134 made of a material that is insulating and/or nonmagnetic, preferably both. This then further reduces the risks of breakdown and the parasitic capacitances.

A plasma formed using such a device has numerous advantages in the context of automotive ignition, including an appreciable reduction in the rate of misfires in a stratified lean-burn system, reduction in electrode wear, or the tailoring of the ignition initiation volume to suit the density.

Radiofrequency excitation is also suited to a plasma deposition application, in a gas that has a density of between $10^{-2}$ mol/l and $5\times10^{31\ 2}$ mol/l. The gas used in this application typically may be nitrogen or air, ambient air in particular.

Radiofrequency excitation is further suited to an application of reducing the pollution of a gas of a density of between $10^{31\ 2}$ mol/l and $5\times10^{31}$ mol/l.

Radiofrequency excitation is also suited to a lighting application calling upon a gas with a molar density of between 0.2 mol/l and 1 mol/l.

According to the present invention, in order to optimize the Q-factor Q=Lw/R, it is necessary to determine L, that represents the inductance, and R that represents the resistance. To do that, a long coil model with rectangular turns has been adopted.

The current that flows through the wires of the coil 112 will be spread between the interior surface and the exterior surface of the wires in that ratio of the magnetic fields. If the coil is considered to be long enough, and thanks to the presence of the shield, the magnetic field in the coil support and in the space between the coil and the shield is uniform. The flux in the space between the coil and the shield is therefore substantially equal to the flux in the coil support, and the magnetic fields are therefore in the ratios of the cross sections, which gives:

$$B_{ext}=B_{int}\times r^2_{int}/(r^2_{ext}-r^2_{int})$$

where $r_{int}$ is the radius of the coil, $r_{ext}$ is the radius of the shield, $B_{int}$ is the magnetic field in the coil and $B_{ext}$ is the magnetic field between the coil and the shield.

By accepting that the distribution of current is entirely dependent on surface area, application of Navier-Stokes to $\mu_0 B$ to a square circuit of a width equal to the pitch crossing the surface gives:

$$I_{ext}=B_{ext}/(\mu_0\times\text{pitch}) \text{ and } I_{int}=B_{int}/(\mu_0\times\text{pitch})$$

by setting $$I=I_{int}+I_{ext} \text{ and } x=r_{int}/r_{ext}$$

we get $$I_{int}/I=1-x^2 \text{ and } I_{ext}/I=x^2$$

where I represents the electrical current, $I_{ext}$ represents the electrical current in the shield and $I_{int}$ represents the electrical current in the coil.

The variable x which represents the ratio of the radius of the coil to the radius of the shield can thus be expressed and it is necessary now to express R and L as a function of x so as to find a value of x that maximizes Q=Lw/R.

The losses energy balance gives:

$$RI^2=\rho\frac{n2\pi}{\delta\cdot\text{pitch}}(r_{int}(I^2_{ext}+I^2_{int})+r_{ext}I^2_{ext})$$

i.e.:

$$R=\rho\frac{n2\pi}{\delta\cdot\text{pitch}}r_{ext}(2x^4+x^3-2x^2+1)$$

In addition, the inductance L can be calculated as follows:

$$LI=nB_{int}\pi r^2_{int}=\mu_0 n\frac{I_{int}}{\text{pitch}}\pi r^2_{int}=\mu_0 n\frac{I(1-x^2)}{\text{pitch}}\pi r^2_{int}$$

Thus the quality factor is equal to:

$$Q=\frac{Lw}{R}=\frac{\mu_0\delta\omega}{2\rho}r_{ext}\frac{x(1-x^2)}{(2x^4+x^3-2x^2+1)}$$

In the knowledge that $$\delta=\sqrt{\frac{2\rho}{\mu_0\omega}},$$

it can be deduced that:

$$Q=\frac{Lw}{R}=\frac{r_{ext}}{\delta}\frac{x(1-x^2)}{(2x^4+x^3-2x^2+1)}$$

Figure 2:
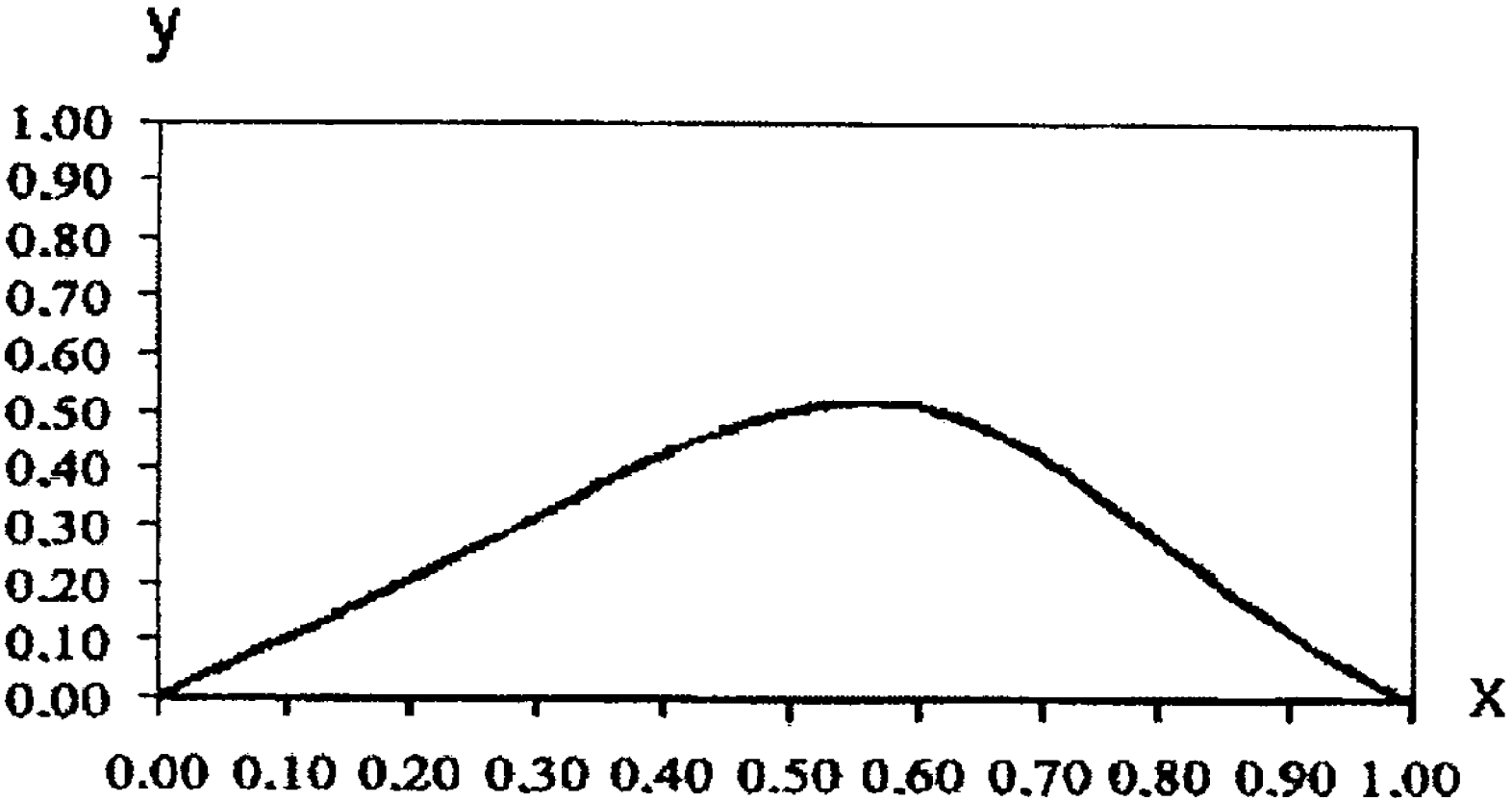
FIG. 2 is a graph depicting a study of the Q-factor (y) as a function of the $r_{int}/r_{ext}$ ratio (x).

Thus, by setting $$y=\frac{x(1-x^2)}{2x^4+x^3-2x^2+1},$$

a study of this function gives the graph depicted in FIG. 2 and makes it possible to establish that the maximum in the polynomial fraction lies at y=0.516 for x=0.56.

Thus, in conclusion, it is apparent from this calculation that the ratio of the coil radius to the shield radius needs to be 0.56 in order to have the maximum Q-factor.

However, having carried out tests and as shown by the curve, it would appear that a ratio of coil radius to shield radius lying in a range from 0.5 to 0.6 yields highly satisfactory results, allowing a considerable improvement in the Q-factor.

This parameter thus allows any type of radiofrequency plasma generating device, for example an engine spark plug, to optimize its Q-factor.

It is important to point out that applying such a range of ratio between the diameter of a coil and of a shield can, according to one preferred embodiment, be applied to an engine spark plug but can also be applied to any radiofrequency plasma generating device.

The invention claimed is:

1. A plasma generating device comprising:

two electrodes;

a series resonator with a resonant frequency higher than 1 MHz and comprising a capacitor comprising two terminals and a single inductive coil surrounded by a shield, the capacitor and the coil being arranged in series, the electrodes being connected to the respective terminals of the capacitor, and the shield and the inductive coil are separated by an insulating sleeve, a ratio of a radius of the coil to a radius of the shield is between 0.5 and 0.6.

2. The device as claimed in claim 1, wherein the series resonator has a resonant frequency in a range from 1 MHz to 20 MHz.

3. The device as claimed in claim 1, wherein the device is a radiofrequency plasma generating device which is an engine spark plug.

4. The device as claimed in claim 1, wherein the insulating sleeve is made of a material that has a dielectric coefficient greater than 1.

5. The device as claimed in claim 4, wherein an exterior surface of the insulating sleeve is metallized and constitutes the shield.

6. The device as claimed in claim 1, wherein the shield comprises a conductive loop.

7. The device as claimed in claim 1, wherein the inductive coil is wound around a solid element made of a nonmagnetic material.

8. The device as claimed in claim 5, wherein one of the insulating materials has a withstand voltage higher than 20 kV/mm.

9. The device as claimed in claim 1, wherein the device is configured to ignite combustion in an internal combustion engine motor vehicle.

10. The device as claimed in claim 1, wherein the device is configured to sterilize in an air-conditioning method.

11. The device as claimed in claim 1, wherein the ratio of the radius of the coil to the radius of the shield is equal to 0.56.

12. The device as claimed in claim 1, wherein the ratio of the radius of the coil to the radius of the shield is between 0.5 and 0.6 to maximize a quality factor, the quality factor being calculated according to the following equation:

$$Q=L\cdot w/R,$$

with Q being the quality factor, L being an inductance of the device, w being the frequency, and R being a resistance of the device.

13. The device as claimed in claim 1, wherein the ratio of the radius of the coil to the radius of the shield is between 0.5 and 0.6 to maximize a quality factor, the quality factor being calculated according to the following equation:

$$Q = \frac{Lw}{R} = \frac{r_{ext}}{\delta}\frac{x(1-x^2)}{(2x^4+x^3-2x^2+1)}$$

with Q being the quality factor, L being an inductance of the device, w being the frequency, R being a resistance of the device, $r_{ext}$ being the radius of the shield, δ being a skin depth of the shield, and x being a variable which represents the ratio of the radius of the coil to the radius of the shield.

* * * * *